US005516322A

United States Patent [19]

Myers

[11] Patent Number: 5,516,322

[45] Date of Patent: May 14, 1996

[54] LIQUID FILLABLE TRANSPARENT DOLLS

[76] Inventor: Jeff D. Myers, 7525 N. Shadow Mountain Rd., Paradise Valley, Ariz. 85253

[21] Appl. No.: 370,407

[22] Filed: Jan. 9, 1995

[51] Int. Cl.[6] ..... A63H 3/52; A63H 3/36

[52] U.S. Cl. ..... 446/267; 446/390

[58] Field of Search ..... 446/267, 220, 446/221, 222, 223, 226, 379, 380, 376, 390, 97, 99; 285/351

[56] References Cited

U.S. PATENT DOCUMENTS

| | | | |
|---|---|---|---|
| 1,341,985 | 6/1920 | Kemp | 446/267 |
| 1,968,492 | 7/1934 | Kallas | 446/380 |
| 2,731,768 | 1/1956 | Harrowe | 446/226 |
| 3,634,966 | 1/1972 | Ostrander | 446/380 |
| 3,736,966 | 6/1973 | Dichiara | 285/351 X |
| 3,816,957 | 6/1974 | Nakajima | 446/379 |
| 4,242,830 | 1/1981 | Hauser | 446/267 X |
| 4,715,624 | 12/1987 | Frye | 285/351 X |
| 4,761,314 | 8/1988 | Marshall | 446/267 X |
| 5,224,863 | 7/1993 | Lauer et al. | 446/267 X |
| 5,236,384 | 8/1993 | Fabricant et al. | 446/267 |
| 5,338,245 | 8/1994 | Murza et al. | 446/267 |

FOREIGN PATENT DOCUMENTS

| | | | |
|---|---|---|---|
| 1298787 | 6/1962 | France | 446/226 |
| 941546 | 11/1963 | United Kingdom | 446/226 |

*Primary Examiner*—Robert A. Hafer
*Assistant Examiner*—D. Neal Muir
*Attorney, Agent, or Firm*—Warren F. B. Lindsley

[57] ABSTRACT

A liquid fillable transparent doll formed of a plurality of hollow relatively movable body parts that are interconnected to form a common reservoir wherein a liquid filling the reservoir provides the color of the outer appearance of the doll.

6 Claims, 2 Drawing Sheets

LIQUID FILLABLE TRANSPARENT DOLLS

BACKGROUND OF THE INVENTION

This invention relates to dolls and more particularly to liquid fillable transparent dolls that assume the color of the filling liquid. The dolls including their hollow heads, trunks, arms, legs and feet comprise a common reservoir. The parts of the dolls may be moved relative to their trunks without a leakage problem.

DESCRIPTION OF THE PRIOR ART

Prior art dolls are stuffed with cotton, wood, plastic foam or the like to form a three dimensional object the outer surface of which is covered by various forms of doll clothing.

SUMMARY OF THE INVENTION

In accordance with the invention claimed, a new and improved transparent doll is disclosed the hollow parts of which together form a common reservoir for receiving a predetermined colored liquid. The color of the liquid controls the color of the doll.

It is, therefore, one object of this invention to provide a new and improved transparent doll for receiving in the hollow interior of its parts a liquid that controls the color of the outer appearance of the doll.

Another object of this invention is to provide a transparent doll formed of a resin the hollow parts of which interconnect to form a common reservoir.

A further object of this invention is to provide a doll the hollow interior of its parts form a reservoir for its liquid content and wherein at least some of its parts are movable in a leak proof manner.

A still further object of this invention is to provide a hollow transparent liquid fillable doll formed of a resilient, pliable material that assumes a given initial shape after being distorted.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

The present invention may be more readily described by reference to the accompanying drawings, in which.

DESCRIPTION OF THE PREFERRED EMBODIMENT

Figure 1:
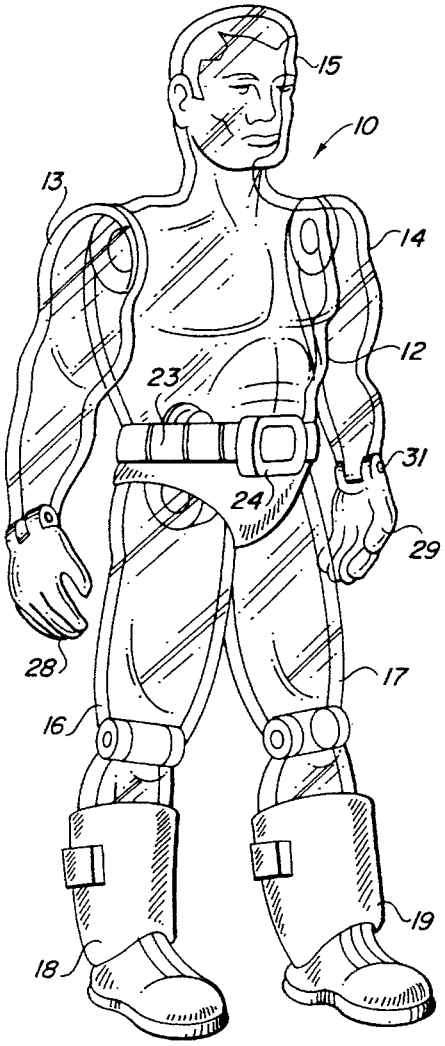
FIG. 1 is a perspective view of a transparent liquid fillable doll the parts of which form a common reservoir and embodying the invention.

Referring more particularly to the drawings by characters of reference, FIGS. 1–11 disclose a doll like character 10 which comprise a trunk 12, arms 13 and 14, head 15, legs 16 and 17 and ankle foot parts 18 and 19. Character 10 although forming a man like doll may comprise any doll configuration the parts of which form a common reservoir 20. Reservoir 20 comprising all of its hollow parts is filled by an inlet port 21 which is closed by a plug 22, shown in FIG. 5, and covered by a belt 23 and buckle 24 as shown in FIG. 1.

The doll is formed of a resilient transparent liquid impervious material 25 forming an envelope comprising each of the hollow parts of the doll. These parts are connected together to form a common, single cavity or reservoir which is filled with liquid 27. The liquid not only gives the doll weight but also makes it possible for the user to change the doll's color by changing the color of its liquid content.

Figure 5:
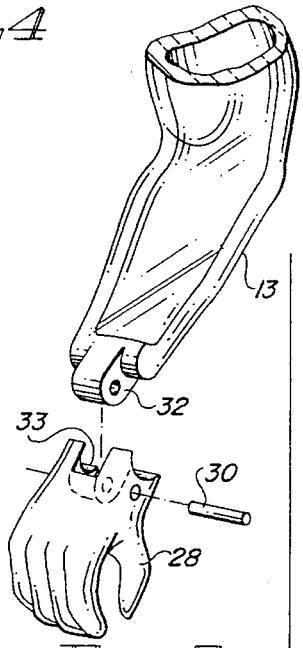
FIG. 5 is an exploded view of the lower arm and hand of the doll shown in FIG. 1 illustrating a pivotal connection of the hand to the lower arm.

Arms 13 and 14 of the doll are pivotally mounted in a fluid tight manner with its solid hands 28 and 29 pivotally connected to the ends of the hollow arms 13 and 14 by pins 30 and 31 which extend through the hand and an arbor 32 which rests and turns in a support 33 in the hand, as shown in FIG. 5.

Figure 2:
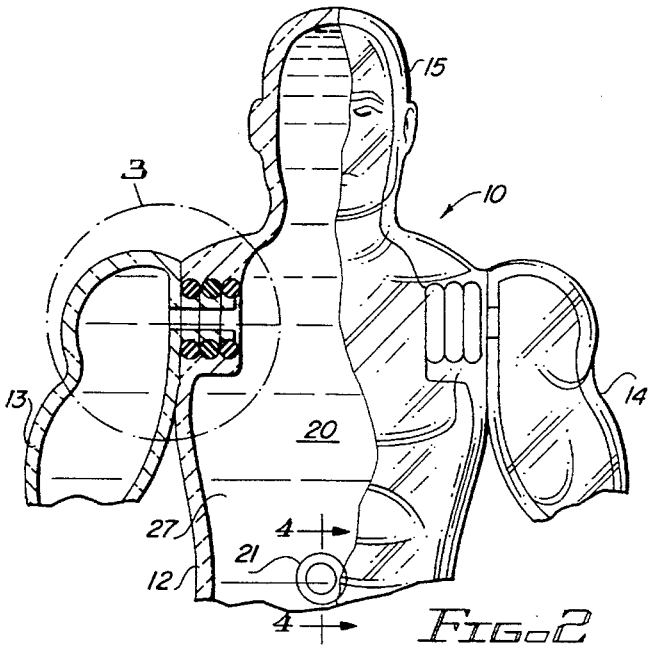
FIG. 2 is a partial view of FIG. 1 with a part thereof in cross section and showing an inlet port for liquid filling purposes.
Figure 4:
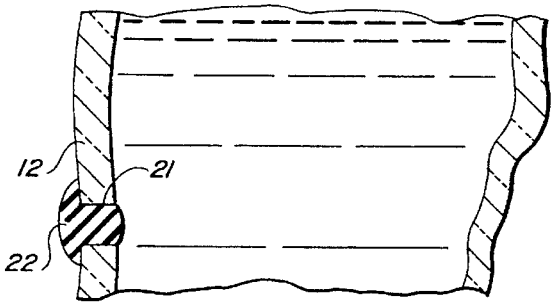
FIG. 4 is a cross sectional view of FIG. 2 taken along the line 4—4.
Figure 3:
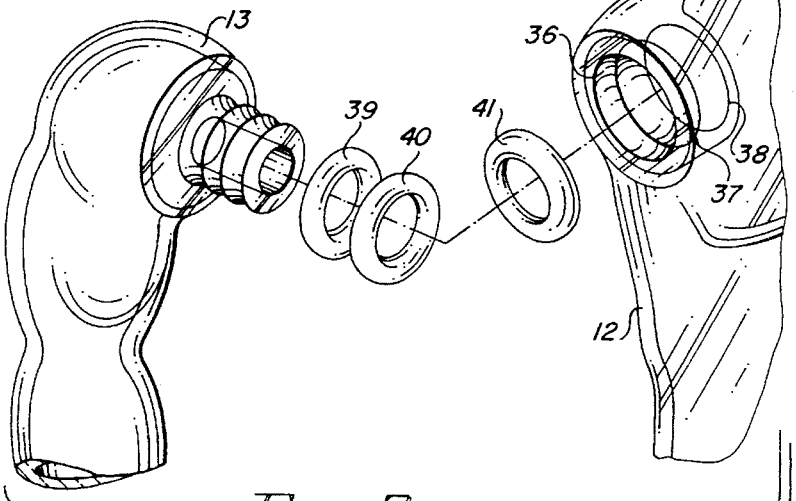
FIG. 3 is an exploded view of the circled area marked 3 in FIG. 2 showing a leak proof connection of the arm to the shoulder of the doll.
Figure 6:
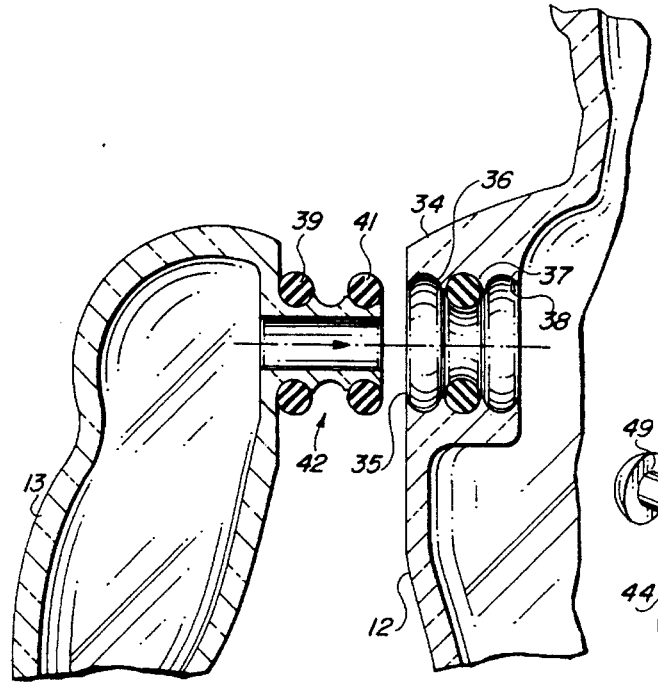
FIG. 6 is an exploded view illustrating the mounting of the upper arm to the shoulder of the doll.

FIGS. 2, 3 and 6 illustrate the parts and manner of connecting the upper arm to the shoulder of the doll. The shoulder 34 of the doll is provided with an opening or socket 35 the periphery of which is contoured to provide three juxtapositioned parallelly arranged grooves 36, 37 and 38 that are arranged to receive therein three identical resilient O-rings 39, 40 and 41. O-rings 39 and 40 are arranged to be tightly and spacedly mounted on a stud or protrusion 42 mounted on the upper arm of the doll for fitting into socket 35 in the manner shown to form a liquid tight joint even upon movement of the arm relative to the shoulder of the doll.

To assemble arm 13 to the shoulder of the doll, ring 40 is placed in groove 37 of socket 35 of shoulder 34 of the doll and rings 39 and 41 are tightly arranged in grooves 36 and 37 in the protrusion 42 of the doll's arm 13. At this point, protrusion 42 is forced in socket 35 of the doll in the manner shown in FIG. 6 to form the leak proof connection shown in FIG. 2.

Figure 7:
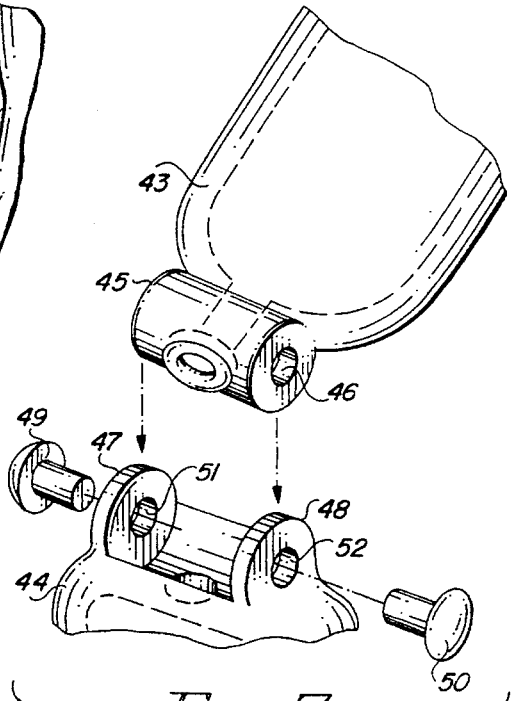
FIG. 7 is an exploded view of the pivotal connection of the upper and lower limbs of the doll shown in FIG. 1.

FIG. 7 illustrates one means of connecting the upper limb 43 of arm 13 to the lower limb 44 of the doll, i.e. elbow, in a leak proof manner while maintaining liquid communication between the upper and lower limbs of the doll during elbow movement. As shown, the upper arm 43 is provided with a protrusion 45 comprising a cylindrical configuration having a cylindrical opening 46 extending therethrough laterally of the longitudinal axis of the upper limb 43 of the arm of the doll. This protrusion fits between two flanges 47 and 48 which extend outwardly of the end of lower limb 44 juxtapositioned to the upper limb 43.

A pair of pins 49 and 50 are arranged into and through cylindrical opening 51 and 52 in flanges 47 and 48 and into the cylindrical opening 46 when protrusion 45 of upper limb 43 is placed between flanges 47 and 48 to hold the upper and lower limbs 43 and 44 together.

Figure 8:
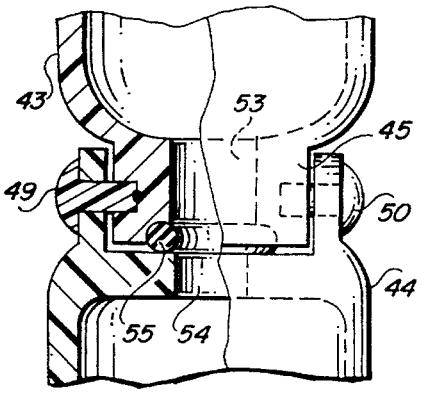
FIG. 8 is a view partially in section of the elbow, knee or waist connections to the associated parts of the doll.

As shown in FIGS. 7 and 8, the hollow interiors of upper and lower limbs 43 and 44 are interconnected by a passageway comprising two interconnecting parts 53 and 54. Parts 53 and 54 are aligned and interconnected by an O-ring 55 when protrusion 45 of the upper limb is connected to the lower limb 44 as shown in FIG. 8.

It should be noted that this form of connection may be used for the elbow, knee or waist joint and still fall within the scope of this invention.

Figure 9:
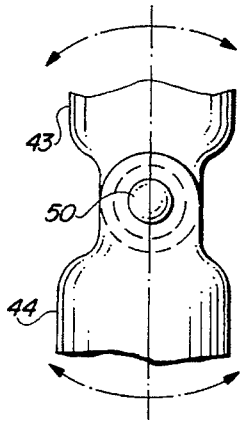
FIG. 9 is a right end view of FIG. 8 illustrating the rotational function of the parts shown.

FIG. 9 illustrates the pivotal movement of the elbow, knee or waist joint shown in FIG. 8.

Figure 10:
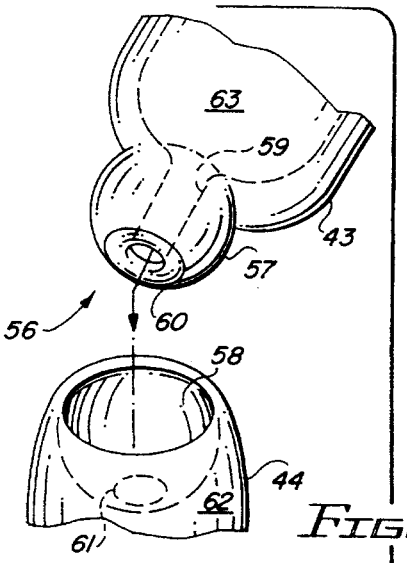
FIG. 10 illustrates the rotational action of the ball and socket joint of the ankle, wrist, neck and waist of the doll shown in FIG. 1.
Figure 11:
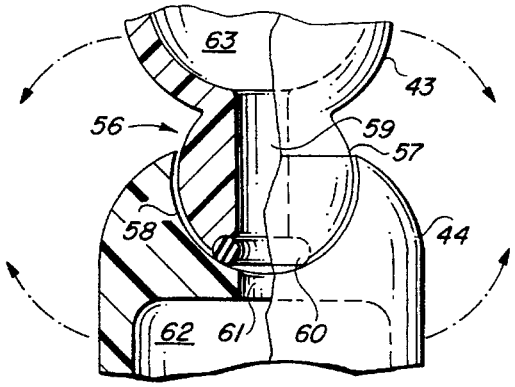
FIG. 11 illustrates the rotational effect of the ball and socket joint of the head of the doll.

FIGS. 10 and 11 illustrate a joint 56 for interconnecting upper and lower limbs 43 and 44 together by using the ball and socket joint 56 or for the interconnection of various size ankle, wrist, neck or waist connections.

As shown, the ball and socket joint 56 comprises a ball 57 and an associated socket 58. Ball 57 is provided with a passageway 59 extending therethrough which is axially aligned with upper limb 43 of the doll. An O-ring 60 is partially embedded in the outer circumference of ball 57 and axially aligned with the passageway 59. Socket 58 is provided with passageway 61 interconnecting socket 58 with the hollow interior 62 of the lower arm 44 and the hollow interior 63 of the upper arm 43.

It should be noted that all joints of the body parts of the doll may be movable in a fluid tight arrangement with the waist of the doll also movable relative to all of the body parts.

Although but two embodiments have been illustrated and described, it will be apparent to those skilled in the art that various changes and modifications may be made therein without departing from the spirit of the invention or from the scope of the appended claims.

What is claimed is:

1. A liquid-fillable doll which comprises pre-molded hollow body parts formed of transparent, substantially rigid, liquid-impervious material, interconnected in fluid-tight relationship, wherein said body parts include, a trunk having an interior and terminating at an upper end in a pair of shoulders each provided with a cylindrical socket for receiving an upper end of an arm;

a pair of arms each having a hollow interior and at an upper end a hollow cylindrical protrusion having an outer periphery fitted within a respective shoulder socket with the interior thereof in liquid-tight communication with the interior of said trunk a pair of spaced apart legs each having a hollow interior and connected to a lower end of said trunk with the interior of each leg in liquid-tight communication with the interior of said trunk;

wherein the interconnected interiors of said trunk, said arms and said legs constitute a reservoir for containing a liquid, and port means in communication with the interior of one of said body parts, said port means being normally closed and adapted to be opened for introducing liquid to or removing liquid from said reservoir, the intended liquid to be introduced having an inherent color, this color determining an overall color for the doll.

2. The liquid-fillable doll of claim 1 wherein said port means comprises an opening formed in a wall of said trunk, said opening being normally closed with a stopper.

3. The liquid-fillable doll of claim 1 wherein said arms are movable relative to said trunk, and wherein the cylindrical protrusion of each arm has at least one O-ring fitted into at least one groove formed in the outer periphery of said protrusion and sealingly engaging a respective cylindrical socket.

4. The liquid-fillable doll of claim 3 wherein an O-ring is fitted into a groove formed in each cylindrical socket in sealing engagement with the periphery of a respective cylindrical protrusion.

5. The liquid-fillable doll of claim 1 wherein each arm comprises upper and lower hollow arm portions, and means sealingly and pivotally interconnecting said upper and lower arm portions adapted to permit relative movement of said upper and lower arm portions while allowing fluid communication therebetween.

6. The liquid-fillable doll of claim 1 wherein each leg comprises upper and lower hollow leg portions, and means sealingly and pivotally interconnecting said upper and lower leg portions adapted to permit relative movement of said upper and lower leg portions while allowing fluid communication therebetween.

* * * * *